US005857756A

United States Patent [19]

Fehre

[11] Patent Number: 5,857,756

[45] Date of Patent: Jan. 12, 1999

[54] LIFTING AND LOWERING DEVICE FOR FURNITURE ELEMENTS

[76] Inventor: Jürgen Fehre, Polenzer Strasse 11, D-01665 Semmelsberg, Germany

[21] Appl. No.: 899,233

[22] Filed: Jul. 23, 1997

[51] Int. Cl.[6] ..... A47B 77/08

[52] U.S. Cl. ..... 312/246; 312/266; 312/325

[58] Field of Search ..... 312/246, 266, 312/247, 282, 245, 312, 272, 248, 325, 319.5, 319.8

[56] References Cited

U.S. PATENT DOCUMENTS

| | | | |
|---|---|---|---|
| 1,303,697 | 5/1919 | McLaughlin | 312/266 |
| 1,434,880 | 11/1922 | Drysdale | 312/266 X |
| 2,635,030 | 4/1953 | Stebbins et al. . | |
| 3,081,138 | 3/1963 | Stebbins | 312/325 X |
| 3,224,827 | 12/1965 | Foster et al. | 312/266 |
| 4,134,629 | 1/1979 | Hansen | 312/246 |
| 4,915,461 | 4/1990 | Kingsborough et al. . | |
| 5,224,677 | 7/1993 | Close | 312/325 X |
| 5,228,763 | 7/1993 | Gingold . | |
| 5,249,858 | 10/1993 | Nusser | 312/248 X |

FOREIGN PATENT DOCUMENTS

| | | | |
|---|---|---|---|
| 2524407 | 12/1976 | Germany | 312/325 |
| 36 13 530 | 7/1987 | Germany . | |
| 6078829 | 3/1994 | Japan | 312/266 |
| 9423612 | 10/1994 | WIPO . | |

*Primary Examiner*—Jose V. Chen
*Assistant Examiner*—James O. Hansen
*Attorney, Agent, or Firm*—Collard & Roe, P.C.

[57] ABSTRACT

In a furniture assembly comprising a furniture element mounted on a base plate on a vertical wall for movement between an upper position close to the wall and a lower position remote from the wall, the furniture element comprises a device for moving the furniture element between the upper and lower positions and a guiding device. The moving device comprises a drive, pivots fixedly connected to the base plate, the drive being connected to the pivots, coupling links and pivoting elements connecting the coupling links to the pivots. The guiding device comprises coupling links and pivots connecting the coupling links of the guiding device to the base plate. The moving device is connected to a pivot fixedly connected to a common fixing device, and pivots connect the coupling links of the guiding device to the common fixing device.

8 Claims, 3 Drawing Sheets

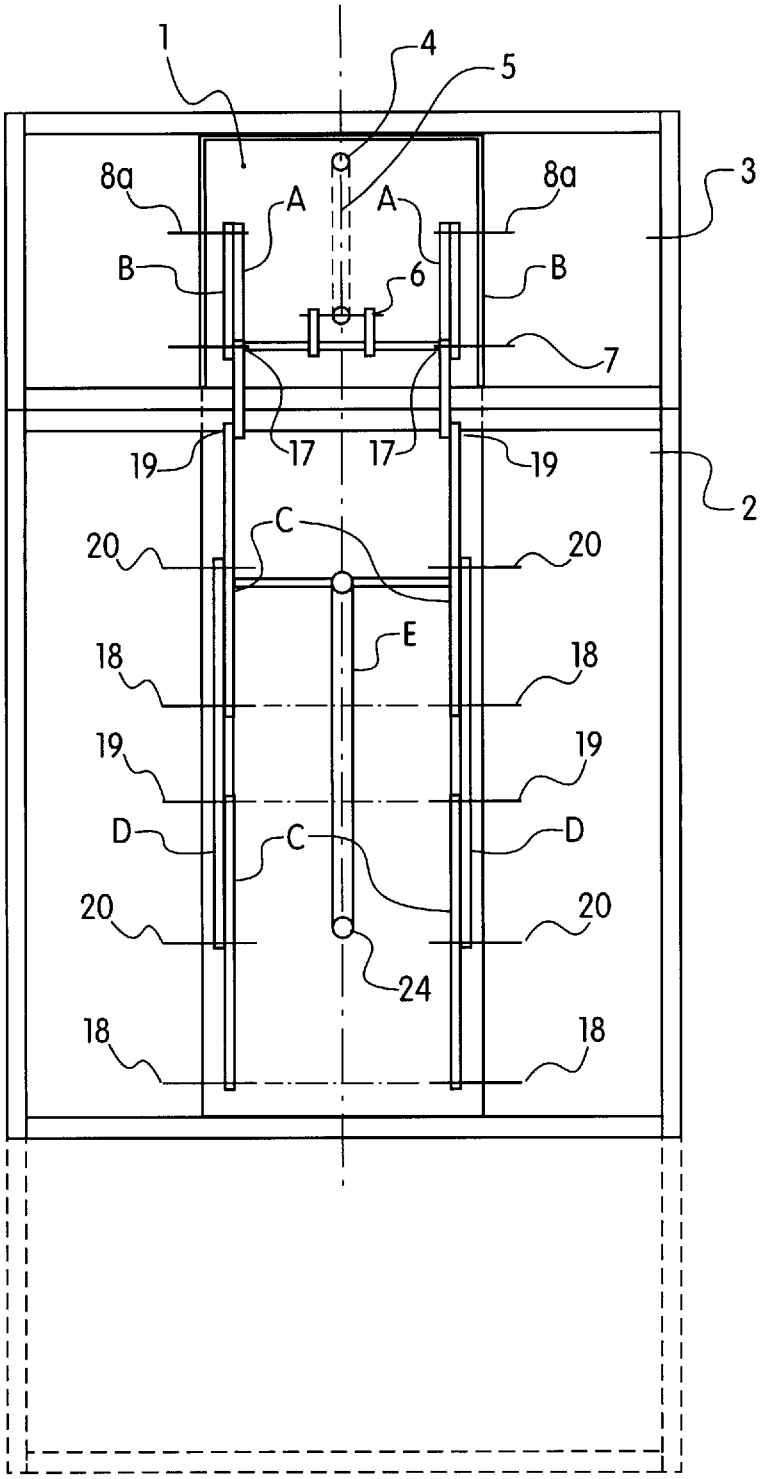
Fig. 2
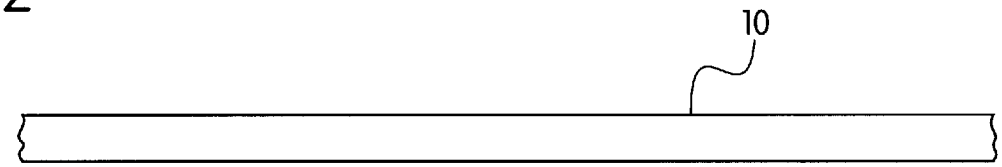

LIFTING AND LOWERING DEVICE FOR FURNITURE ELEMENTS

BACKGROUND OF THE INVENTION

1. Field of the Invention

The present invention relates to a furniture assembly comprising a furniture element mounted on a base plate on a vertical wall for movement between an upper position close to the wall and a lower position remote from the wall.

2. Description of the Prior Art

Wall-mounted cabinets which may be lowered are known. For example, German patent No. 3,613,530 discloses a cabinet which may be mounted on a vertical wall and whose position may be adjusted between an upper end position close to the wall and a lower end position remote from, and parallel to, the wall. According to the patent, at least one guiding device comprised of two guiding elements is affixed to a base plate, the guiding device being arranged on the base plate, on the one hand, and being connected to the cabinet, on the other hand.

Other known arrangements comprise guide plates wherebetween guide profiles run in the direction of the movement of the cabinet. Further known guiding devices comprise pairs of elements whose guide arms are connected to the base plate and the cabinet.

All the known systems have in common that the guiding device is arranged at the side of the movable cabinet and require a side wall which is connected to the base plate.

Pressure fluid-actuated drives built into the cabinets are used for lifting and lowering the cabinets.

All the known arrangements have the disadvantage that they restrict the useful space in the movable cabinets. Furthermore, the arrangement of the guiding device on the side of the cabinet has the disadvantage that it requires considerable structural changes of the cabinets.

SUMMARY OF THE INVENTION

It is the primary object of this invention to provide a furniture assembly of one or more furniture elements which may be singly or together moved without losing space at the side of the furniture elements or useful space inside the furniture elements.

It is another object of the invention to make it possible to use any type of standard, mass-produced furniture elements as movable furniture elements, without requiring structural changes.

The above and other objects are accomplished according to the present invention with a furniture assembly comprising a furniture element mounted on a base plate on a vertical wall for movement between an upper position close to the wall and a lower position remote from the wall, the furniture element comprising a device for moving the furniture element between the upper and lower positions, the moving device comprising a drive, pivots fixedly connected to the base plate, coupling links and pivoting elements connecting the coupling links; a device for guiding the furniture element during the movement, the guiding device comprising coupling links and pivots connecting the coupling links of the guiding device to the base plate; and a common fixing device, a pivot fixedly connected to the common fixing device and connected to the moving device, and pivots connecting the coupling links of the guiding device to the common fixing device.

The moving and guiding devices are hidden to maintain the same optical impression as conventional furniture elements, and they are generally sturdy, free of maintenance requirements and substantially noiseless. They also may be readily installed without excessive costs.

BRIEF DESCRIPTION OF THE DRAWING

The above and other objects, advantages and features of this invention will become more apparent from the following detailed description of certain now preferred embodiments thereof, taken in conjunction with the accompanying schematic drawing wherein

FIG. 2 is an end view of the embodiment of FIG. 1; and

DETAILED DESCRIPTION OF THE PREFERRED EMBODIMENTS

Figure 1:
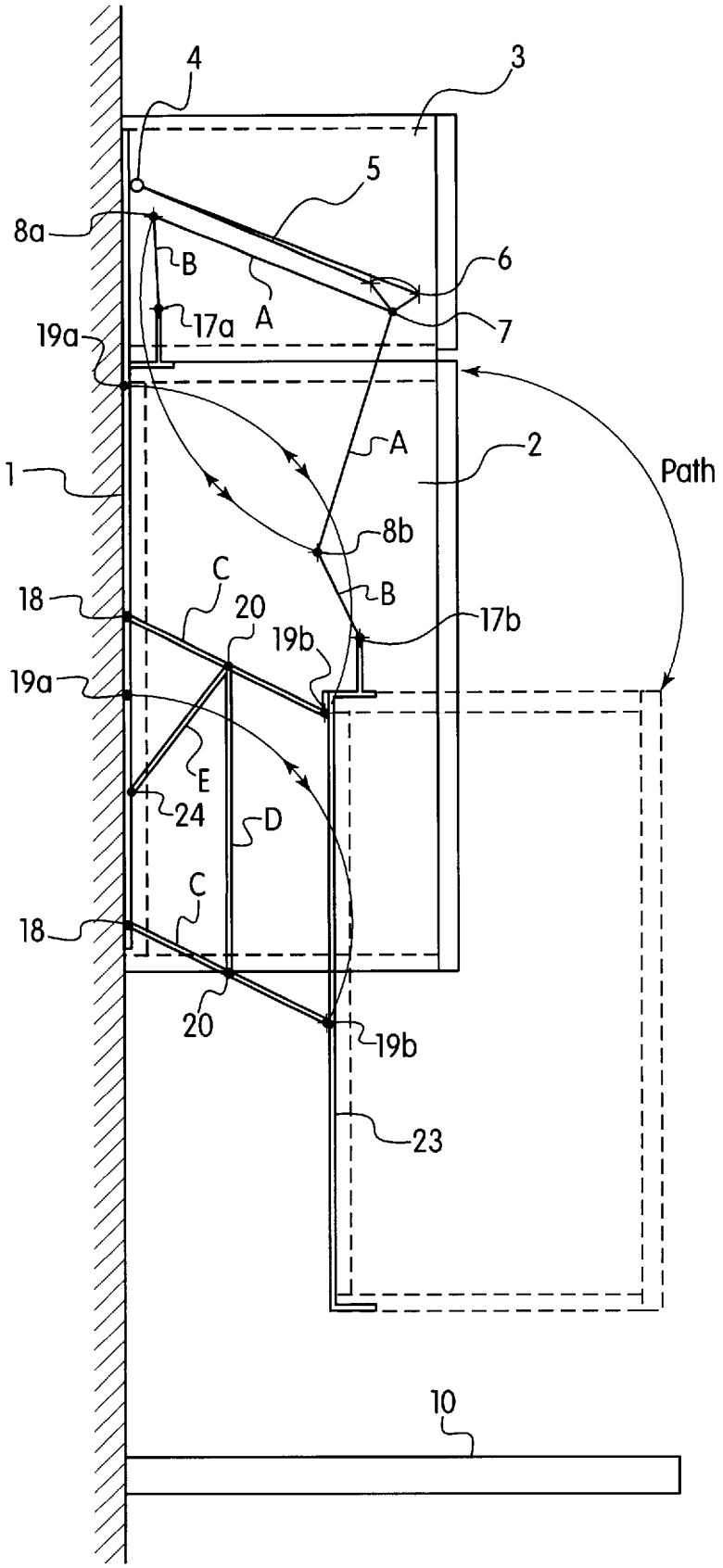
FIG. 1 is a diagrammatic side view of a furniture assembly according to one embodiment of the invention.

Referring now to the drawing, wherein like reference numerals in all figures designate like parts functioning in a like manner, there is shown a furniture assembly comprising furniture element 2 mounted on base plate 1 on a vertical wall for movement along a path indicated by an arcuate arrow between an upper position close to the wall (shown in full lines) and a lower position remote from the wall (shown in broken lines). Furniture element 2 comprises a device for moving the furniture element between the upper and lower positions. The moving device comprises drive 5, pivots 4 and 7 fixedly connected to base plate 2, coupling links A and B, and pivoting elements 6, 8 connecting coupling link A to pivot 7 and coupling link B to pivot 17.

Furniture element 2 further comprises a device for guiding the furniture element during the movement, the guiding device comprising coupling links C and pivots 18 (FIG. 1) and 13 and 22 (FIG. 3) connecting coupling links C to base plate 2. Furniture element 2 carries common fixing device 23, and pivot 17 is fixedly connected to the common fixing device and connected to the moving device, and pivots 19 (FIG. 1) and 12 (FIG. 3) connect coupling links C of the guiding device to common fixing device 23.

Drive 5 for adjusting the position of furniture element 2 may be an electrically, pneumatically or hydraulically operated drive which may be remote-controlled in a conventional manner. It preferably comprises a spindle and is so operated that the spindle is moved up or down in the operating direction. Drive 5 is pivoted to base plate 1 at fixed pivot 4 and fixed pivot 7 transmits the driving force by coupling links A, B, pivoting element 8 and pivot 17 to common fixing device 23. As shown in the drawing, coupling links A are connected at one end to fixed pivot 7 while their opposite ends are connected to pivoting element 8. Coupling links B are connected at one end to pivoting element 8 while their opposite ends are connected to pivot 17 fixedly connected to common fixing device 23 and pivot 17 fixedly connected to base plate 1.

In the embodiment shown in FIGS. 1 and 2, coupling links C of the guiding device are arranged parallel to each other, and pivots 18 and 19 fixedly connect coupling links C to base plate 1 and common fixing device 23. Another coupling link D and pivoting elements 20 connect parallel coupling links C to coupling link D. Damping element E is pivoted to base plate 1 at pivot 24 fixedly connected to the base plate and extends between base plate 1 and one of the pivoting elements 20 connecting parallel coupling links C to the other coupling link D.

Figure 3:
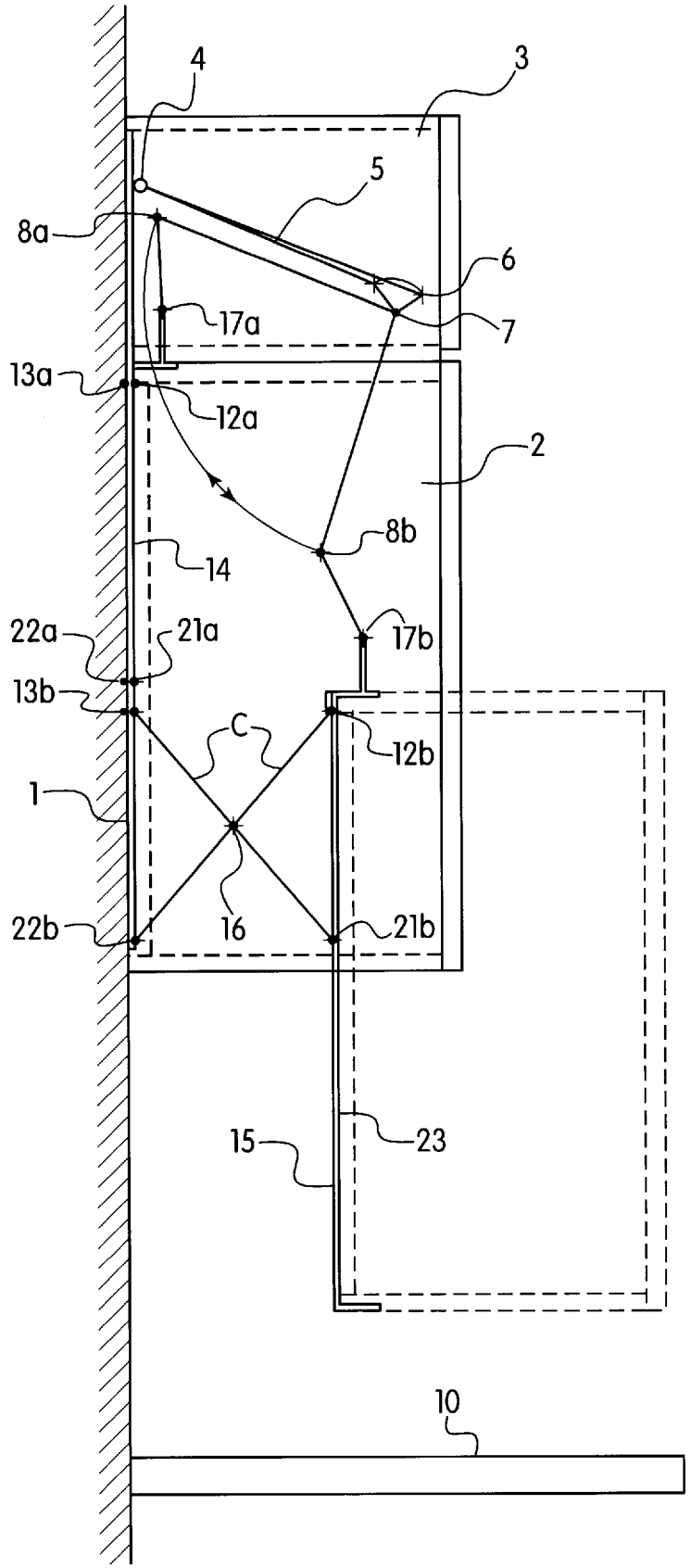
FIG. 3 is a side view similar to FIG. 1 and showing another embodiment.

In the embodiment shown in FIG. 3, a pivoting element 16 connects coupling links C of the guiding device like scissors to each other, pivots 13 and 22 adjustably connecting coupling links C of the guiding device to base plate 1 and pivot 12 fixedly connecting one of the coupling links to common fixing device 23 and another pivot 21 adjustably connecting another one of the coupling links C to the common fixing device.

Preferably, base plate 1 has a standard size so that it may be used universally. The moving and guiding devices are connected to the base plate and may be economically manufactured so that the entire assembly may be mounted on the wall in a very simple manner.

The common fixing device constitutes a connection between the moving and guiding devices as well as a means for mounting furniture element 2. Pivots 17, and 19 (FIG. 1) and 12 (FIG. 3) fixedly connected to common fixing device 23 connect the moving and guiding devices to the common fixing device and secure move and guide furniture element 2. The structure of the movable furniture element need not be changed, the only requirement being the attachment of the common fixing device to the rear wall of the furniture element.

As shown in the drawing, another furniture element 3 is fixedly mounted on the wall above furniture element 2 and houses the moving device. This preferred feature makes it possible to use solely the space in the fixed furniture element for mounting the moving device while the entire inside space of the movable furniture element is unencumbered. Fixed furniture element 3 is hard to reach by a handicapped person while the movable furniture element 2 is designed for ready access when in the lowered position.

Referring to the operation of the embodiment of FIGS. 1 and 2, when drive 5 is retracted, coupling link A is so pivoted about fixed pivot 7 that point 8*a* and pivot 17*a* are moved to position 8*b* and 17*b*. This causes furniture element 2 to move in the path shown by an arcuate arrow in FIG. 1 to move the furniture element from its upper end position adjacent the wall to its lower end position remote from the wall. To guide the furniture element parallel to the wall, coupling links C of the guiding device are pivoted to base plate 1 at fixed pivots 18 while pivots 19 move from points 19*a* to points 19*b*.

In the operation of the embodiment of FIG. 3, drive 5 is operated in the same manner as in FIG. 1. The guidance of furniture element 2 during its downward movement proceeds in a scissors-like manner. Pivot 12 fixedly connected to common fixing device 23 is moved from point 12*a* to point 12*b*, forcing pivots 13, 21 and 22, which are guided along guide tracks 14 and 15 to be moved from points 13*a*, 21*a* and 22*a* to points 13*b*, 21*b* and 22*b*. Guide track 14 is provided on base plate 1 and guide track 15 is provided on the backside of common fixing device 23. The pivotal connection between coupling links C by pivoting element 16 enables the coupling links to move like scissors.

What is claimed is:

1. A furniture assembly comprising (a) a base plate mounted on a vertical wall, (b) a furniture element having a rear side facing the vertical wall and being movable between an upper position close to the wall and a lower position remote from the wall, (c) a device for moving the furniture element between the upper and lower positions, (d) a device for guiding the furniture element during the movement, (1) the moving and guiding devices being fixedly connected to the base plate, and (c) a common fixing device separate from, but connected to, the rear side of the furniture element, (1) the moving device comprising a drive pivoted to the base plate and coupling links linking the drive to the common fixing device, and (2) the guiding device comprising coupling links and pivots connecting the coupling links of the guiding device to the base plate and to the common fixing device.

2. The furniture element of claim 1, wherein the coupling links of the guiding device are arranged parallel to each other.

3. The furniture element of claim 2, further comprising another coupling link and pivoting elements connecting the parallel coupling links to the other coupling link.

4. The furniture element of claim 3, further comprising a damping element pivoted to the base plate and extending between the base plate and one of the pivoting elements connecting the parallel coupling links to the other coupling link.

5. The furniture element of claim 1, further comprising a pivoting element connecting the coupling links of the guiding device like scissors to each other, the pivots connecting the coupling links of the guiding device to the base plate and to the common fixing device comprising pivots adjustably connecting the coupling links to the base plate, a pivot fixedly connecting one of the coupling links to the common fixing device and another pivot adjustably connecting another one of the coupling links to the common fixing device.

6. The furniture element of claim 1, wherein the base plate has a standard size.

7. The furniture element of claim 1, wherein the common fixing device constitutes a connection between the moving and guiding devices as well as a means for mounting the furniture element.

8. The furniture assembly of claim 1, further comprising another furniture element fixedly mounted on the wall above the first-named furniture element, the other furniture element housing the moving device.

* * * * *